US005336429A

United States Patent [19]

Barthélemy et al.

[11] Patent Number: 5,336,429

[45] Date of Patent: Aug. 9, 1994

[54] VIRTUALLY CONSTANT BOILING POINT COMPOSITIONS BASED ON ISOFLURANE

[75] Inventors: Pierre Barthélemy, Jodoigne; Mireille Paulus, Brussels, both of Belgium; Hans Buchwald, Ronnenberg, Fed. Rep. of Germany; Joachim Hellmann, Hanover, Fed. Rep. of Germany; Boleslaus Raszkowski, Wiedensahl, Fed. Rep. of Germany

[73] Assignee: Solvay (Société Anonyme), Brussels, Belgium

[21] Appl. No.: 923,689

[22] Filed: Aug. 3, 1992

[30] Foreign Application Priority Data

Aug. 1, 1991 [BE] Belgium ..... 09100711

[51] Int. Cl.[5] ..... C11D 7/30; C11D 7/50

[52] U.S. Cl. ..... 252/171; 252/162; 252/170; 252/364; 252/DIG. 9

[58] Field of Search ..... 252/162, 171, 172, 364, 252/DIG. 9; 134/12, 31, 38, 40, 42

[56] References Cited

U.S. PATENT DOCUMENTS

| | | | |
|---|---|---|---|
| 3,535,425 | 10/1970 | Terrell | 514/722 |
| 3,539,462 | 11/1970 | Schofield | 252/170 |
| 3,846,332 | 11/1974 | Croix | 252/364 |
| 3,903,009 | 9/1975 | Bauer et al. | 252/171 |
| 4,346,246 | 8/1982 | Terrell et al. | 568/684 |
| 4,985,169 | 1/1991 | Rolland et al. | 252/69 |
| 4,999,127 | 3/1991 | Merchant | 252/171 |
| 5,023,010 | 6/1991 | Merchant | 252/171 |

FOREIGN PATENT DOCUMENTS

| | | |
|---|---|---|
| 0322786 | 7/1989 | European Pat. Off. . |
| 0325265 | 7/1989 | European Pat. Off. . |
| 0389133 | 9/1990 | European Pat. Off. . |
| 8910984 | 11/1989 | PCT Int'l Appl. . |
| 8912118 | 12/1989 | PCT Int'l Appl. . |

*Primary Examiner*—Linda Skaling
*Assistant Examiner*—A. Hertzog
*Attorney, Agent, or Firm*—Spencer, Frank & Schneider

[57] ABSTRACT

The invention relates to azeotropic and pseudoazeotropic compositions containing isoflurane with a lower alcohol or an ester. These compositions can be used in particular as a solvent for cleaning electronic components and for degreasing metals.

20 Claims, No Drawings

VIRTUALLY CONSTANT BOILING POINT COMPOSITIONS BASED ON ISOFLURANE

FIELD OF THE INVENTION

The invention relates to azeotropic and pseudoazeotropic compositions containing a fluorine-containing ether in combination with an alcohol or an ester and the uses of these compositions, in particular as a cleaning solvent.

TECHNOLOGY REVIEW

Completely halogenated chlorofluorinated solvents (CFC), such as 1,1,2-trichloro-1,2,2-trifluoroethane (CFC-113) are widely used industrially for degreasing and cleaning various surfaces, particularly for complex parts difficult to clean. The solvents may be used in various ways, mainly either cold or hot.

CFC-113 is often used for cleaning printed circuit boards and for cleaning or degreasing precision components, in particular optical, mechanical or electronic components. Various compositions based on CFC-113 are also conventionally used as a desiccant in order to remove the water adsorbed at the surface of delicate components.

CFC-113 is used either in the pure form or as a mixture with other compounds, in particular alkanes, alcohols or esters, which increase the solvent power of the product. The use of mixtures of an azeotropic type is then of interest, since the composition of the bath does not vary over time or during the various steps of the cleaning process.

Numerous compositions based on CFC-113 have been developed with a view to these diverse applications. The following may be mentioned by way of examples: Patent BE-A-822,223, describing CFC-113/ethanol/nitromethane compositions, and U.S. Pat. No. 3,539,462 relating to compositions based on CFC-113, 1,1-dichloroethane and methanol, ethanol, isopropanol, tert-butanol, 2,2-dimethylbutane or 2,3-dimethylbutane.

However, CFC-113, like other completely halogenated chlorofluoroalkanes, is now suspected of giving rise to environmental problems, on the one hand with regard to the destruction of the stratospheric ozone layer and on the other hand with regard to atmospheric warming (greenhouse effect). The influence which a product may have on the ozone layer, relative to CFC-11, has been quantified, from complex mathematical models, by its ozone destruction potential (ODP). The influence of a product on the greenhouse effect is expressed, still with respect to CFC-11, by its global warming potential (GWP). According to the model used, the ODP of CFC-113 varies from 0.8 to 0.9 and its GWP from 1.3 to 1.4. Consequently, there is currently an urgent need to find new solvent compositions which have little or no adverse influence on the ozone layer.

To this end, some azeotropic compositions based on certain not completely halogenated chlorofluorocarbons, known by the generic term hydrochlorofluorocarbons (HCFC) or hydrofluoroalkanes (HFA), such as 1,1-dichloro-1-fluoroethane (HCFC-141b) or 2,2-dichloro-1,1,1-trifluoroethane (HCFC-123), in particular as a mixture with methanol or ethanol, have been proposed (EP-A-325265; EP-A-389133; WO89/10984; WO89/12118). These compounds have a much lower ODP and GWP than CFC-113. HCFC-141b has an ODP of the order of 0.10 and a GWP of less than 0.1. HCFC-123 has an ODP of the order of 0.02 and a GWP of less than 0.1. The boiling point of the various azeotropic or pseudoazeotropic compositions containing these compounds is, however, a little too low to permit their use in present devices for cleaning by solvent without necessitating modification of existing apparatus.

Moreover, it is disclosed in Patent BE-764,791 that isoflurane (1-chloro-2,2,2-trifluoroethyl difluoromethyl ether), which is mainly used as an anaesthetic, may also be used as a solvent or as a degreasing agent.

SUMMARY OF THE INVENTION

One of the aims of the present invention is to provide new azeotropic or pseudoazeotropic compositions which have a particularly good performance when they are used as a solvent and more particularly as a solvent for cleaning surfaces or as a degreasing agent. The invention also relates to such compositions which have properties that are particularly suitable for cleaning printed circuit boards. A further aim of the invention is to provide compositions which have a boiling point sufficiently close to that of the compositions based on CFC-113 to permit their use in present devices for cleaning by solvent without necessitating modification of existing apparatus. Yet a further aim of the invention is to provide such compositions having a particularly low ODP and GWP, which compositions accordingly can be used to replace the solvents based on completely halogenated chlorofluoroalkanes.

DETAILED DESCRIPTION OF THE INVENTION

The present invention relates to azeotropic or pseudoazeotropic compositions containing isoflurane and at least one alcohol or at least one ester. The boiling point of isoflurane at atmospheric pressure is about 49.5° C. Isoflurane appears particularly interesting with regard to its impact on the environment. In fact, it has a very low ODP of about 0.01 and a GWP of about 0.03.

Preferably, the alcohol is a lower alcohol, such as, in particular, methanol, ethanol, propanol or isopropanol. The isoflurane/methanol and isoflurane/ethanol azeotropic or pseudoazeotropic compositions are preferred. The isoflurane/methanol azeotropic or pseudoazeotropic compositions are particularly preferred.

Preferably, the ester is an ester containing from 2 to 6 carbon atoms, such as, in particular, methyl acetate, ethyl acetate, methyl formate, ethyl formate or ethyl propionate. The isoflurane/methyl acetate, isoflurane/methyl formate and isoflurane/ethyl formate azeotropic or pseudoazeotropic compositions are preferred.

An azeotropic or pseudoazeotropic composition is understood to be any mixture of two or more substances which has a virtually constant boiling point and which behaves as a pure substance, that is to say for which the composition of the vapour produced by evaporation or by distillation is essentially identical to the composition of the liquid mixture. In practice, these azeotropes or pseudoazeotropes which have a virtually constant boiling point, either minimum or maximum, are therefore not separable by simple distillation and accordingly their composition remains constant during operations for cleaning with a solvent as well as during operations for recovery of spent solvents by distillation. Fundamentally, the thermodynamic state of a fluid is defined by four independent variables: the pressure (P), the temperature (T), the composition of the liquid phase (X)

and the composition of the gas phase (Y). An azeotrope or a pseudoazeotrope is a particular system containing 2 or more components for which, at a given temperature and at a given pressure, X is essentially equal to Y. The compositions according to the invention are characterised by their compositions observed at atmospheric pressure. It is self-evident that this does not restrict the compositions according to the invention to these particular compositions. In fact, it is well known that the composition and the boiling point of an azeotrope containing 2 or more constituents vary depending on the pressure conditions used.

The binary mixtures consisting of about 70 to 99.9% by weight of isoflurane and about 30 to 0.1% by weight of methanol form azeotropes or pseudoazeotropes according to the invention. The azeotropes or the pseudoazeotropes formed by the binary mixtures consisting of about 85 to 99.7% by weight of isoflurane and about 15 to 0.3% by weight of methanol are preferred. The azeotropes or the pseudoazeotropes formed by the binary mixtures consisting of about 92 to 98% by weight of isoflurane and about 8 to 2% by weight of methanol are particularly preferred. At atmospheric pressure, the binary composition consisting of about 95.8% by weight of isoflurane and about 4.2% by weight of methanol is a true azeotrope, the boiling point of which is about 47° C. This composition is very particularly preferred.

The binary mixtures consisting of about 85 to 99.99% by weight of isoflurane and about 15 to 0.01% by weight of ethanol also form azeotropes or pseudoazeotropes according to the invention. The azeotropes or the pseudoazeotropes formed by the binary mixtures consisting of about 90 to 99.9% by weight of isoflurane and about 10 to 0.1% by weight of ethanol are preferred. The azeotropes or the pseudoazeotropes formed by the binary mixtures consisting of about 95 to 99.8% by weight of isoflurane and about 5 to about 0.2% by weight of ethanol are particularly preferred. At atmospheric pressure, the binary composition consisting of about 99.3 by weight of isoflurane and about 0.7% by weight of ethanol is a true azeotrope, the boiling point of which is about 49.4° C. This composition is very particularly preferred.

The binary mixtures consisting of about 25 to 85% by weight of isoflurane and about 75 to 15% by weight of methyl acetate also form azeotropes or pseudoazeotropes according to the invention. The azeotropes or the pseudoazeotropes formed by the binary mixtures consisting of about 50 to 75% by weight of isoflurane and about 50 to 25% by weight of methyl acetate are preferred. The azeotropes or the pseudoazeotropes formed by the binary mixtures consisting of about 56 to 72% by weight of isoflurane and about 44 to 28% by weight of methyl acetate are particularly preferred. At atmospheric pressure the binary composition consisting of about 64.7% by weight of isoflurane and about 35.3% by weight of methyl acetate is a true azeotrope, the boiling point of which is about 64° C. This composition is very particularly preferred.

The binary mixtures consisting of about 70 to 99.9% by weight of isoflurane and about 30 to 0.1% by weight of methyl formate also form azeotropes or pseudoazeotropes according to the invention. The azeotropes or the pseudoazeotropes formed by the binary mixtures consisting of about 85 to 99.8% by weight of isoflurane and about 15 to 0.2% by weight of methyl formate are preferred. The azeotropes or the pseudoazeotropes formed by the binary mixtures consisting of about 90 to 99.5% by weight of isoflurane and about 10 to 0.5% by weight of methyl formate are particularly preferred. At atmospheric pressure the binary composition consisting of about 94.3% by weight of isoflurane and about 5.7% by weight of methyl formate is a true azeotrope, the boiling point of which is about 50.0° C. This composition is very particularly preferred.

The binary mixtures consisting of about 30 to 90% by weight or isoflurane and about 70 to 10% by weight of ethyl formate also form azeotropes or pseudoazeotropes according to the invention. The azeotropes or the pseudoazeotropes formed by the binary mixtures consisting of about 40 to 80% by weight of isoflurane and about 60 to 20% by weight of ethyl formate are preferred. The azeotropes or the pseudoazeotropes formed by the binary mixtures consisting of about 55 to 75% by weight of isoflurane and about 45 to 25% by weight of ethyl formate are particularly preferred. At atmospheric pressure the binary composition consisting of about 65.9% by weight of isoflurane and about 34.1% by weight of ethyl formate is a true azeotrope, the boiling point of which is about 59.7° C. This composition is very particularly preferred.

Small amounts of other additives may also be added to the compositions according to the invention. It is thus possible for stabilisers, surfactants or any other additives permitting improvement of their performance during use to be added to said compositions. The other optional additives are added in an amount of about 0,001 to 5% by weight of the azeotropic or pseudoazeotropic mixture.

The compositions according to the invention have numerous uses.

By virtue of their azeotropic or pseudoazeotropic character, the compositions according to the invention may be used in any process for cleaning by means of a solvent, without separation of these compositions into their constituents occurring by evaporation or by distillation. These compositions have very good compatibility with the various types of surfaces to be treated, whether these are metal, plastic or glass surfaces.

The compositions according to the invention are suitable for any operation for cold cleaning, either simply by immersion of the parts to be cleaned in the solvent or by washing the parts with a cloth, a sponge or any other article soaked in the solvent.

Another field of application for which the compositions according to the invention are particularly valuable is vapour-cleaning of surfaces. In its sleepiest form, vapour degreasing consists in exposing, at room temperature, the article to be cleaned to the vapours of the solvent brought to the boil. By condensing on the article, the vapours of the distilled solvent remove grease and any other contamination.

For contaminations which are more difficult to remove and require a treatment at higher temperature in order to improve the cleaning power of the solvent, or for large cleaning installations in which cleaning of metal parts or assemblies must be carried out efficiently and rapidly, the vapour degreasing operation conventionally consists firstly in immersion of the part to be cleaned in the liquid solvent at boiling point, optionally in combination with an ultrasonic treatment, which operation removes the bulk of the contaminations, then in immersion of the part, at a temperature close to ambient temperature, in freshly distilled solvent and finally in exposure of the part to the solvent vapours which, by condensing on said part, effect a final rinsing. This latter step may optionally be preceded by spraying the part with liquid solvent. Because of their azeotropic or pseudoazeotropic character, the compositions according to the invention are particularly suitable for these cleaning processes.

The compositions according to the invention also appear particularly effective in processes for cleaning printed circuit boards, which processes are intended to remove from the surface of said boards the pickling flux used in the electronic component soldering step and its residues. The cleaning of electronic parts, in particular flux removal from printed circuit boards, is a cleaning operation which is particularly important from an industrial standpoint and increasingly difficult to carry out because of the current trend towards increasingly complex printed circuit boards with an increasing density of electronic components. Conventionally, the processes for soldering electronic components on the boards use a coating of the latter with a pickling flux followed by passage of the board covered in this way into a molten solder. The flux cleans the conducting metal parts and promotes adherence of the solder. Conventional soldering fluxes consist of rosin, used on its own or with specific activators. The soldering, which is carried out at high temperature, gives rise to an at least partial degradation of the flux. The latter and its residues are removed from the surface of printed circuit boards in a particularly efficient and selective manner by the compositions according to the invention, even when said fluxes are highly activated. The azeotropic or pseudoazeotropic compositions in fact have a high solvent power for the flux and its residues without, however, impairing the material of which the board support is made or the electronic components arranged on the board. Moreover, the compositions according to the invention have, in particular, viscosity and surface tension characteristics which are particularly suitable for this application.

The compositions according to the invention may also be used in any other process as a replacement for compositions based on CFC-113. They are particularly suitable as a desiccant, that is to say in order to remove the water adsorbed at the surface of solid articles which must have a perfectly clean surface, such as printed circuits, silicon chips, optical glasses, removable parts of time pieces and any other precision components.

EXAMPLES

The following nonlimiting examples illustrate the invention in more detail.

EXAMPLE 1

A glass apparatus consisting of a boiling flask surmounted by a reflux condenser was used to demonstrate the existence of azeotropic or pseudoazeotropic compositions between isoflurane and methanol. The temperature of the liquid was measured using a thermometer immersed in the flask.

25 ml of pure isoflurane are heated to the boil at atmospheric pressure and small amounts of methanol are then progressively introduced into the flask using a graduated syringe, via a side tube fitted with a septum.

The azeotropic composition is determined by recording the change in the boiling point of the mixture as a function of its composition. The composition for which a minimum or maximum boiling point is observed is the azeotropic composition at the atmospheric pressure.

The influence of the atmospheric pressure on the boiling point of the mixtures is corrected with the aid of the following equation:

$$tc = tr + 0.00012\ (760 - P)\ (273 + tr)$$

where tr is the recorded temperature in ° C.

tc is the corrected temperature in ° C., and

P is the atmospheric pressure at the time of measurement, in mm Hg.

Table I collates the corrected boiling points obtained for various compositions of isoflurane and methanol.

The best estimate of the composition for which the boiling point is minimum is about 95.8% by weight of isoflurane. The boiling point is 47.2° C.±0.2° C. for compositions containing about 92 to 98% by weight of isoflurane.

EXAMPLE 2

This example illustrates the azeotrope based on isoflurane and ethanol, demonstrated with the aid of the same procedure as that used in Example 1.

Table II collates the corrected boiling points obtained for various compositions of isoflurane and ethanol.

The best estimate of the composition for which the boiling point is maximum is about 99.3% by weight of isoflurane. The boiling point is 49.6° C.±0.2° C. for compositions containing about 96.5 to 100% by weight of isoflurane.

EXAMPLE 3

This example illustrates the azeotrope based on isoflurane and methyl acetate, demonstrated with the aid of the same procedure as that used in Example 1.

Table III collates the corrected boiling points obtained for various compositions of isoflurane and methyl acetate.

The best estimate of the composition for which the boiling point is maximum is about 64.7% by weight of isoflurane. The boiling point is 63.8° C.±0.2° C. for compositions containing about 57 to 71% by weight of isoflurane.

EXAMPLE 4

This example illustrates the azeotrope based on isoflurane and methyl foremate, demonstrated with the aid of the same procedure as that used in Example 1.

Table IV collates the corrected boiling points obtained for various compositions of isoflurane and methyl formate.

The best estimate of the composition for which the boiling point is maximum is about 94.3% by weight of isoflurane. The boiling point is 49.9° C.±0.2° C. for compositions containing about 90 to 98% by weight of isoflurane.

EXAMPLE 5

This example illustrates the azeotrope based on isoflurane and ethyl formate, demonstrated with the aid of the same procedure as that used in Example 1.

Table V collates the corrected boiling points obtained for various compositions of isoflurane and ethyl formate.

The best estimate of the composition for which the boiling point is maximum is about 65.9% by weight of isoflurane. The boiling point is 59.5° C.±0.2° C. for compositions containing about 56 to 73% by weight of isoflurane.

EXAMPLES 6–9

Flux Removal from Printed Circuits

Printed circuit boards carrying residues of soldering flux containing rosin of type FSW 26 according to the DIN 8511 classification and of type RMA according to the MIL-F-14256 specifications were treated with various flux removal compositions in a laboratory apparatus simulating a 3-chamber cleaning unit. Each board is first immersed for 3 minutes in 80 ml of the hot solvent mixture, under ultrasound, is then transferred to a bath of the same composition at ambient temperature, where it remains for a further 3 minutes, and then finally is kept for 1 minute in the vapours of the cleaning composition brought to the boil.

The efficacy of the flux removal compositions is estimated, on the one hand, by assessing the appearance of the boards using an optical microscope at 30× magnification and, on the other hand, by determining the ionic residue. This determination of the residual ionic impurities is carried out by extraction of these residual impurities by washing the boards in a bath of isopropanol/water (75/25% by volume) and then determining the electrical conductivity of the bath. The ionic residue content is expressed in μg NaCl equivalents per $cm^2$ surface area of the printed circuit board (μg eq/$cm^2$).

The results obtained with a pseudoazeotropic composition according to the invention and, by way of comparison, with other azeotropic compositions are collated in Table VI.

EXAMPLE 10

Drying of Solid Surfaces

Optical glasses, silicon chips, aluminum components and polyethylene components were treated in a drying installation comprising 4 successive steps (spraying/immersion/spraying/vapour treatment) using a composition of 95.6% by weight of isoflurane/44.4% by weight of methanol.

The various surfaces obtained after treatment are perfectly dry and completely free from all traces of adsorbed water. After evaporation, no residue of the drying composition remains on the surfaces.

TABLE I

| Methanol added, ml | Percentage of isoflurane by volume | by weight | by mol | Temperature (°C.) |
|---|---|---|---|---|
| 0 | 100.00 | 100.00 | 100.00 | 49.5 |
| 0.2 | 99.21 | 99.58 | 97.63 | 48.6 |
| 0.4 | 98.43 | 99.17 | 95.40 | 48.2 |
| 0.6 | 97.66 | 98.76 | 93.26 | 48.0 |
| 0.8 | 96.90 | 98.35 | 91.19 | 47.5 |
| 1 | 96.15 | 97.94 | 89.20 | 47.4 |
| 1.2 | 95.42 | 97.54 | 87.32 | 47.4 |
| 1.4 | 94.70 | 97.14 | 85.50 | 47.3 |
| 1.6 | 93.98 | 96.74 | 83.75 | 47.2 |
| 1.8 | 93.28 | 96.35 | 82.09 | 47.0 |
| 2 | 92.59 | 95.96 | 80.49 | 47.1 |
| 2.2 | 91.91 | 95.58 | 78.97 | 47.0 |
| 2.4 | 91.24 | 95.19 | 77.46 | 47.0 |
| 2.6 | 90.58 | 94.82 | 76.07 | 47.0 |
| 2.8 | 89.93 | 94.44 | 74.68 | 47.1 |
| 3 | 89.29 | 94.07 | 73.37 | 47.1 |
| 4 | 86.21 | 92.24 | 67.37 | 47.4 |
| 4.5 | 84.75 | 91.36 | 64.74 | 47.6 |
| 5 | 83.33 | 90.48 | 62.27 | 47.7 |
| 6 | 80.65 | 88.80 | 57.93 | 47.9 |
| 7 | 78.13 | 87.17 | 54.13 | 48.2 |
| 8 | 75.76 | 85.60 | 50.79 | 48.5 |

TABLE I-continued

| Methanol added, ml | Percentage of isoflurane by volume | by weight | by mol | Temperature (°C.) |
|---|---|---|---|---|
| 9 | 73.53 | 84.08 | 47.84 | 48.8 |
| 10 | 71.43 | 82.62 | 45.22 | 49.1 |
| 12 | 67.57 | 79.85 | 40.76 | 49.7 |
| 15 | 62.50 | 76.02 | 35.51 | 50.6 |
| 17.5 | 58.82 | 73.09 | 32.05 | 51.1 |
| 20 | 55.56 | 70.39 | 29.22 | 51.9 |
| 25 | 50.00 | 65.54 | 24.83 | 53.0 |

TABLE II

| Ethanol added, ml | Percentage of isoflurane by volume | by weight | by mol | Temperature (°C.) |
|---|---|---|---|---|
| 0 | 100.00 | 100.00 | 100.00 | 49.5 |
| 0.3 | 98.9 | 99.4 | 97.5 | 49.4 |
| 0.6 | 97.6 | 98.7 | 95 | 49.4 |
| 1.0 | 96.3 | 98.0 | 92.5 | 49.5 |
| 1.3 | 95.0 | 97.3 | 90 | 49.7 |
| 1.7 | 93.7 | 96.6 | 87.5 | 49.8 |
| 2.1 | 92.3 | 95.8 | 85 | 50.0 |
| 2.5 | 90.9 | 95.0 | 82.5 | 50.2 |
| 3.0 | 89.3 | 94.1 | 80 | 50.4 |
| 3.4 | 88.0 | 93.3 | 77.5 | 50.6 |
| 4.0 | 86.3 | 92.3 | 75 | 50.9 |
| 4.5 | 84.8 | 91.4 | 72.5 | 51.2 |
| 5.1 | 83.0 | 90.3 | 70 | 51.5 |
| 6.4 | 79.7 | 88.2 | 65 | 52.2 |
| 7.9 | 75.9 | 85.7 | 60 | 53.1 |
| 11.9 | 67.7 | 80.0 | 50 | 55.4 |
| 17.8 | 58.4 | 72.8 | 40 | 58.5 |

TABLE III

| Methyl acetate, ml | Percentage of isoflurane by volume | by weight | by mol | Temperature (°C.) |
|---|---|---|---|---|
| 0 | 100.00 | 100.00 | 100.00 | 49.5 |
| 2 | 92.59 | 95.28 | 89.02 | 52.9 |
| 4 | 86.21 | 91.00 | 80.24 | 55.7 |
| 6 | 80.65 | 87.08 | 73.02 | 58.2 |
| 8 | 75.76 | 83.48 | 66.99 | 59.9 |
| 10 | 71.43 | 80.17 | 61.88 | 61.2 |
| 11 | 69.44 | 78.60 | 59.59 | 61.8 |
| 12 | 67.57 | 77.11 | 57.49 | 62.4 |
| 13 | 65.79 | 75.66 | 55.52 | 62.8 |
| 14 | 64.10 | 74.27 | 53.68 | 63.1 |
| 15 | 62.50 | 72.93 | 51.96 | 63.3 |
| 16 | 60.98 | 71.64 | 50.35 | 63.5 |
| 17 | 59.52 | 70.39 | 48.84 | 63.7 |
| 18 | 58.14 | 69.19 | 47.42 | 63.8 |
| 19 | 56.82 | 68.02 | 46.06 | 63.9 |
| 20 | 55.56 | 66.90 | 44.80 | 64.0 |
| 21 | 54.35 | 65.81 | 43.59 | 64.0 |
| 22 | 53.19 | 64.75 | 42.45 | 64.0 |
| 23 | 52.08 | 63.73 | 41.37 | 64.0 |
| 24 | 51.02 | 62.74 | 40.34 | 64.0 |
| 25 | 50.00 | 61.78 | 39.36 | 63.9 |
| 26 | 49.02 | 60.85 | 38.43 | 63.9 |
| 27 | 48.08 | 59.95 | 37.54 | 63.8 |
| 28 | 47.17 | 59.07 | 36.69 | 63.7 |
| 30 | 45.45 | 57.39 | 35.10 | 63.6 |
| 32 | 43.86 | 55.81 | 33.65 | 63.4 |
| 35 | 41.67 | 53.59 | 31.68 | 63.3 |
| 38 | 39.68 | 51.54 | 29.92 | 63.2 |
| 42 | 37.31 | 49.03 | 27.86 | 62.9 |
| 46 | 35.21 | 46.77 | 26.08 | 62.6 |
| 50 | 33.33 | 44.70 | 24.50 | 62.4 |
| 55 | 31.25 | 42.36 | 22.78 | 61.9 |
| 60 | 29.41 | 40.25 | 21.29 | 61.7 |
| 65 | 27.78 | 38.34 | 19.98 | 61.4 |

TABLE IV

| Methyl formate, ml | Percentage of isoflurane by volume | by weight | by mol | Temperature (°C.) |
|---|---|---|---|---|
| 0 | 100.00 | 100.00 | 100.00 | 49.5 |

TABLE IV-continued

| Methyl formate, ml | Percentage of isoflurane by volume | by weight | by mol | Temperature (°C.) |
|---|---|---|---|---|
| 0.5 | 98.04 | 98.73 | 96.20 | 49.6 |
| 1 | 96.15 | 97.48 | 92.64 | 49.8 |
| 1.5 | 94.34 | 96.27 | 89.36 | 49.9 |
| 2 | 92.59 | 95.09 | 86.31 | 50.1 |
| 2.5 | 90.91 | 93.94 | 83.46 | 50.0 |
| 3 | 89.29 | 92.82 | 80.80 | 50.0 |
| 3.5 | 87.72 | 91.72 | 78.29 | 50.1 |
| 4 | 86.21 | 90.64 | 75.91 | 49.7 |
| 4.5 | 84.75 | 89.60 | 73.71 | 49.6 |
| 5 | 83.33 | 88.57 | 71.61 | 49.5 |
| 5.5 | 81.97 | 87.57 | 69.63 | 49.3 |
| 6 | 80.65 | 86.60 | 67.78 | 48.9 |
| 6.5 | 79.37 | 85.64 | 66.00 | 48.8 |
| 7 | 78.13 | 84.70 | 64.31 | 48.6 |
| 8 | 75.76 | 82.89 | 61.19 | 48.3 |
| 9 | 73.53 | 81.15 | 58.35 | 47.8 |
| 10 | 71.43 | 79.49 | 55.78 | 47.3 |
| 11 | 69.44 | 77.88 | 53.40 | 46.9 |
| 12 | 67.57 | 76.36 | 51.25 | 46.4 |
| 13 | 65.79 | 74.88 | 49.24 | 45.9 |
| 15 | 62.50 | 72.09 | 45.67 | 44.9 |
| 17 | 59.52 | 69.50 | 42.58 | 44.2 |
| 19 | 56.82 | 67.10 | 39.90 | 43.5 |
| 21 | 54.35 | 64.85 | 37.52 | 42.8 |

TABLE V

| Ethyl formate, ml | Percentage of isoflurane by volume | by weight | by mol | Temperature (°C.) |
|---|---|---|---|---|
| 0 | 100.00 | 100.00 | 100.00 | 49.5 |
| 2 | 92.59 | 95.33 | 89.13 | 52.3 |
| 5 | 83.33 | 89.09 | 76.63 | 55.2 |
| 7 | 78.13 | 85.38 | 70.10 | 56.7 |
| 8 | 75.76 | 83.63 | 67.23 | 57.2 |
| 9 | 73.53 | 81.95 | 64.58 | 57.9 |
| 10 | 71.43 | 80.34 | 62.13 | 58.2 |
| 11 | 69.44 | 78.78 | 59.85 | 58.7 |
| 12 | 67.57 | 77.30 | 57.76 | 58.9 |
| 13 | 65.79 | 75.86 | 55.79 | 59.1 |
| 14 | 64.10 | 74.48 | 53.96 | 59.2 |
| 15 | 62.50 | 73.14 | 52.23 | 59.5 |
| 16 | 60.98 | 71.86 | 50.63 | 59.6 |
| 17 | 59.52 | 70.61 | 49.10 | 59.7 |
| 18 | 58.14 | 69.42 | 47.68 | 59.7 |
| 19 | 56.82 | 68.26 | 46.34 | 59.7 |
| 20 | 55.56 | 67.14 | 45.07 | 59.7 |
| 21 | 54.35 | 66.05 | 43.86 | 59.7 |
| 22 | 53.19 | 65.00 | 42.72 | 59.7 |
| 23 | 52.08 | 63.98 | 41.63 | 59.7 |
| 24 | 51.02 | 62.99 | 40.60 | 59.7 |
| 25 | 50.00 | 62.04 | 39.62 | 59.7 |
| 26 | 49.02 | 61.11 | 38.69 | 59.6 |
| 27 | 48.08 | 60.21 | 37.79 | 59.6 |
| 28 | 47.17 | 59.33 | 36.94 | 59.5 |
| 30 | 45.45 | 57.65 | 35.34 | 59.4 |
| 32 | 43.86 | 56.08 | 33.89 | 59.3 |
| 50 | 33.33 | 44.96 | 24.70 | 58.3 |
| 65 | 27.78 | 38.60 | 20.15 | 57.6 |

TABLE VI

| Example | Flux removal composition (% by weight) | Appearance under the microscope | Ionic residue content (NaCl $\mu$g eq./cm$^2$) |
|---|---|---|---|
| 6 | 93.5 isoflurane/ 6.5 methanol | good | 0.2 |
| 7(C) | 93.5 CFC-113/ 6.5 methanol | good | 0.6 |
| 8(C) | 96.7 HCFC-141b/ 3.3 methanol | good | 0.4 |
| 9(C) | 98.2 HCFC-123/ 1.8 methanol | good | 0.7 |

We claim:

1. A virtually constant boiling point composition consisting essentially of a binary mixture of isoflurane and one compound selected from the group consisting of methanol, ethanol, methyl acetate, methyl formate and ethyl formate, said composition containing from about 0.1% to 30% by weight of methanol and from about 99.9 and 70% by weight of isoflurane, said composition having a boiling point at atmospheric pressure of approximately 49.5°±2.5° C.;

from about 0.01% to 15% by weight of ethanol and from about 99.99 to 85% by weight of isoflurane, said composition having a boiling point at atmospheric pressure of approximately 51.4°±2° C.;

from about 15% to 75% by weight of methyl acetate and from about 85 to 25% by weight of isoflurane, said composition having a boiling point at atmospheric pressure of approximately 61.5°±2.5° C.;

from about 0.1% to 30% by weight of methyl formate and from about 70% to 99.9% by weight of isoflurane, said composition having a boiling point at atmospheric pressure of approximately 47.2°±3° C.; or from about 10% to 70% by weight of ethyl formate and from about 30 to 90% by weight of isoflurane, said composition having a boiling point at atmospheric pressure of approximately 57.2°±2.5° C.

2. The virtually constant boiling point composition according to claim 1, consisting essentially of from about 85 to 99.7% by weight of isoflurane and from about 15 to 0.3% by weight of methanol, said composition having a boiling point at atmospheric pressure of approximately 47.9°±0.9° C.

3. The virtually constant boiling point composition according to claim 1, consisting essentially of from about 90 to 99.9% by weight of isoflurane and about 10 to 0.1% by weight of ethanol, said composition having a boiling point at atmospheric pressure of approximately 50.5°±1.1° C.

4. The virtually constant boiling point composition according to claim 1, consisting essentially of from about 50 to 75% by weight of isoflurane and about 50 to 25% by weight of methyl acetate, said composition having a boiling point at atmospheric pressure of approximately 63.5°-0.5° C.

5. The virtually constant boiling point composition according to claim 1, consisting essentially of from about 85 to 99.8% by weight of isoflurane and about 15 to 0.2% by weight of methyl formate, said composition having a boiling point at atmospheric pressure of approximately 49.4°±0.7° C.

6. The virtually constant boiling point composition according to claim 1, consisting essentially of from about 40 to 80% by weight of isoflurane and about 60 to 40% by weight of ethyl formate, said composition having a boiling point at atmospheric pressure of approximately 58.7°±1° C.

7. The virtually constant boiling point composition according to claim 1, consisting essentially of from about 92 to 98% by weight of isoflurane and from about 8 to 2% by weight of methanol, said composition having a boiling point at atmospheric pressure of approximately 47.2°±0.2° C.

8. The virtually constant boiling point composition according to claim 1, consisting essentially of about 95.8% by weight of isoflurane and about 4.2% by weight of methanol, said composition having a boiling point at atmospheric pressure of approximately 47° C.

9. The virtually constant boiling point composition according to claim 1, consisting essentially of from about 0.1 to 10% by weight of ethanol and from about 99.9 to 90% by weight of isoflurane.

10. The virtually constant boiling point composition according to claim 1, consisting essentially of from about 0.2 to about 5% by weight of ethanol and from about 99.8 to 95% by weight of isoflurane.

11. The virtually constant boiling point composition according to claim 1, consisting essentially of from about 0.7 by weight of ethanol and about 99.3 by weight of isoflurane, said composition having a boiling point at atmospheric pressure of approximately 49.4° C.

12. The virtually constant boiling point composition according to claim 1, consisting essentially of from about 25% to about 50% by weight of methyl acetate and from about 75% to about 50% by weight of isoflurane.

13. The constant boiling point composition according to claim 1, consisting essentially of from about 28% to about 44% by weight of methyl acetate and from 72% to about 56% by by weight of isoflurane.

14. The constant boiling point composition according to claim 1, consisting essentially of about 35.3% by weight of methyl acetate and about 64.7% by weight of isoflurane, said composition having a boiling point at atmospheric pressure of approximately 64° C.

15. The constant boiling point composition according to claim 1, consisting essentially of from about 0.2% to about 15% by weight of methyl formate and from 99.8% to about 85% by weight of isoflurane.

16. The virtually constant boiling point composition according to claim 1, consisting essentially of from about 0.5% to about 10% by weight of methyl formate and from about 99.5% to about 90% by weight of isoflurane.

17. The constant boiling point composition according to claim 1, consisting essentially of about 5.7% by weight of methyl formate and about 94.3% by weight of isoflurane, said composition having a boiling point at atmospheric pressure of approximately 50.0° C.

18. The constant boiling point composition according to claim 1, consisting essentially of about 20% to 60% by weight of ethyl formate and from abuot 80% to about 40% by weight of isoflurane.

19. The constant boiling point composition according to claim 1, consisting essentially of about 25% to about 45% by weight of ethyl formate and from about 75% to about 55% by weight of isoflurane.

20. The virtually constant boiling point composition according to claim 1, consisting essentially of about 34.1% by weight of ethyl formate and about 65.9% by weight of isoflurane, said composition having a boiling point at atmospheric pressure of approximately 59.7° C.

* * * * *